United States Patent [19]

Kieser et al.

[11] Patent Number: 4,847,460

[45] Date of Patent: Jul. 11, 1989

[54] APPARATUS FOR INJECTING MICROWAVE ENERGY BY MEANS OF AN OPEN MICROWAVE GUIDE

[75] Inventors: Jörg Kieser, Albstadt; Hans G. Lotz, Gründau; Gonde Dittmer, Erlensee; Michael Sellschopp, Hammersbach, all of Fed. Rep. of Germany

[73] Assignee: Leybold Aktiengesellschaft, Hanau, Fed. Rep. of Germany

[21] Appl. No.: 70,399

[22] Filed: Jul. 7, 1987

[30] Foreign Application Priority Data

Apr. 2, 1987 [DE] Fed. Rep. of Germany ..... 3711184

[51] Int. Cl.[4] ..... H05B 6/70

[52] U.S. Cl. ..... 219/10.55 A; 219/10.55 F

[58] Field of Search ..... 219/10.55 A, 10.55 F, 219/10.55 E, 10.55 R, 121.36, 121.43; 333/239, 252, 136, 137, 240

[56] References Cited

U.S. PATENT DOCUMENTS

| | | | |
|---|---|---|---|
| 2,921,174 | 1/1960 | Haagensen | 219/10.55 F |
| 3,611,582 | 10/1971 | Hamid et al. | 219/10.55 A X |
| 3,704,523 | 12/1972 | Guerga et al. | 219/10.55 A X |
| 3,715,551 | 2/1973 | Peterson | 219/10.55 A |
| 3,814,983 | 6/1974 | Weissfloch et al. . | |
| 3,851,132 | 11/1974 | Van Koughnett | 219/10.55 A |
| 4,266,162 | 5/1981 | McNeill et al. . | |
| 4,314,128 | 2/1982 | Chitre | 219/10.55 F X |
| 4,629,847 | 12/1986 | Gics | 219/10.55 A |

FOREIGN PATENT DOCUMENTS

| | | |
|---|---|---|
| 2948315 | 6/1980 | Fed. Rep. of Germany . |
| 3147986 | 6/1983 | Fed. Rep. of Germany . |

*Primary Examiner*—Philip H. Leung
*Attorney, Agent, or Firm*—Felfe & Lynch

[57] ABSTRACT

A microwave apparatus injects microwave energy into a receptacle that is at least partially transparent to microwave energy. The receptacle has a window of microwave transparent material. The apparatus includes at least one microwave transmitter and one open microwave guide which is connected to the microwave transmitter and which is situated in the immediate vicinity of the receptacle. The open microwave guide has a plurality of parallel rungs and forming a slow - wave structure of the strapped bar type. The microwave guide is of a symmetrical V-shape, and at the apex of the V it is at a smaller distance from the window than at its feed point. A microwave feeder is disposed at at least both ends of the open microwave guide.

6 Claims, 3 Drawing Sheets

FIG. 1
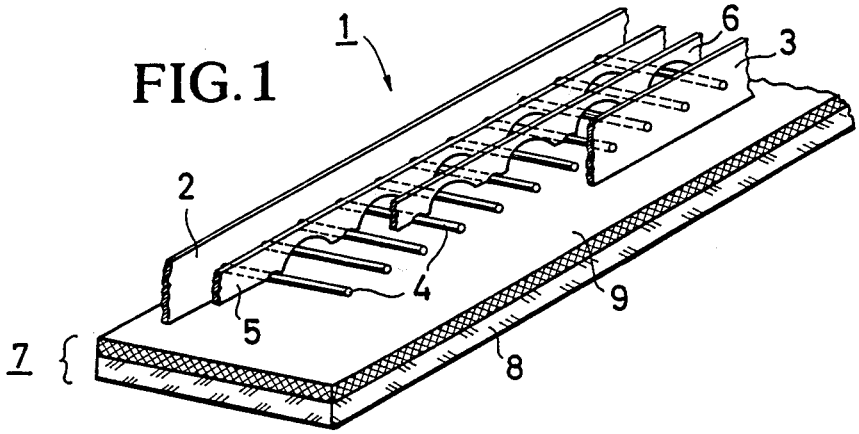
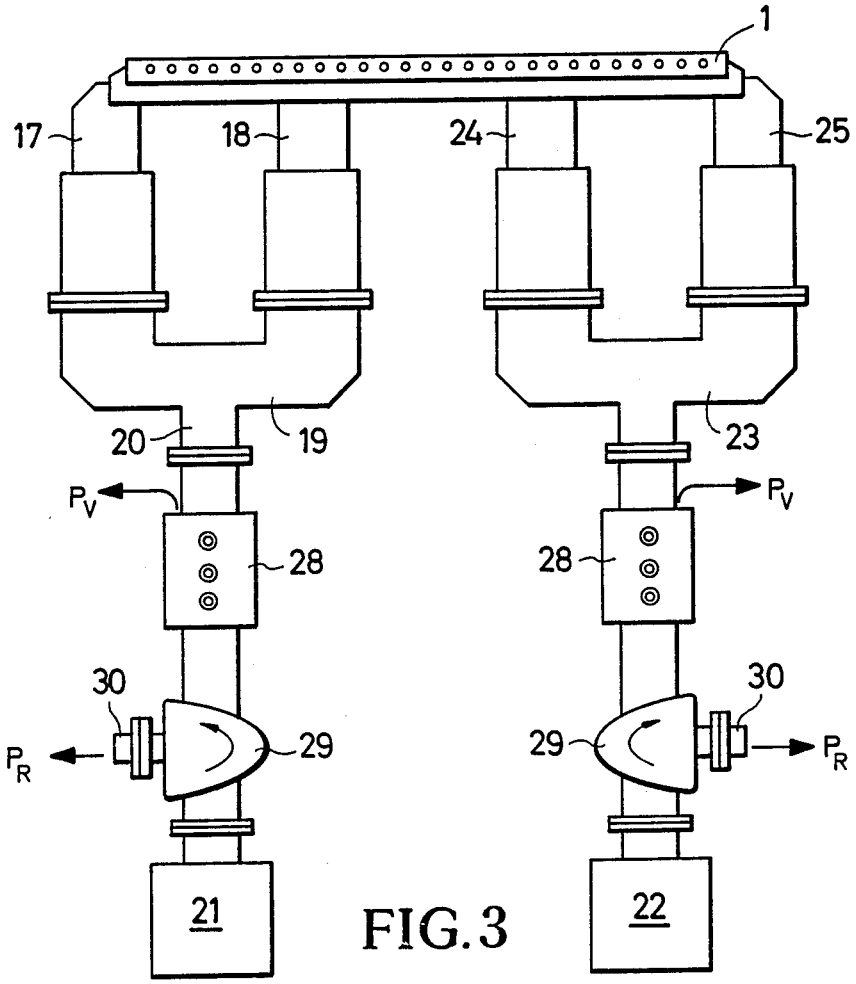
FIG. 3

APPARATUS FOR INJECTING MICROWAVE ENERGY BY MEANS OF AN OPEN MICROWAVE GUIDE

BACKGROUND OF THE INVENTION

The invention relates to an apparatus for the injection of microwave energy into a receptacle that is at least partially transparent to microwave energy, by means of a microwave transmitter and an open microwave guide connected to the microwave transmitter and situated in the direct vicinity of the receptacle.

Such a receptacle either can be made entirely of a material transparent to microwave energy, i.e., it can be formed, for example, by a quartz tube, or it can have a microwave-transparent window of such a material.

An apparatus of the kind described above which has a window is disclosed, for example, in German Pat. No. 31 47 986. The "open microwave guide" consists in this case of a "ladder-like" metal structure having two parallel stringers and numerous "rungs" at equal distances apart and at right angles to the stringers and connecting the latter together electrically. The "rungs" are connected alternately each with one or two central conductors. With such structures it is possible to transmit the microwave power fed to one end over the length of the structure in an approximately uniform manner into the interior of the receptacle. In microwave parlance such structures are also referred to as "slow-wave structures," which can also be described as "delay structures."

"Delay structures" are basically microwave conductors through which a bond electromagnetic wave travels in a particular direction. The electric power is in this case transported, in the form of the electrical field surrounding the structure, at the so-called "group velocity" $v_g$. Independently of this the phase of the wave travels with the phase velocity $v_{Ph}$. The two velocities are also independent in their sign, so that it can easily occur that group velocity and phase velocity run in opposite directions. The expression, "slow," in connection with the waveguide structure, can refer either to the phase velocity or to the group velocity. In general, the group velocity can be between 0 and the speed of light in a vacuum. The value "0" applies to a structure that consists of resonant circuits which are not coupled to one another and through which no wave is running. The velocity of light, however, is achieved in a smooth waveguide. The phase velocity, on the other hand, can also assume values that are greater than the velocity of light.

The group velocity is lowered by loading a straight waveguide with periodically disposed obstacles—i.e., the so-called "rungs" in the case of the ladder structure described above. Depending on how these obstacles are arranged, velocities between 1% and 100% of the velocity of light can be established in practice. An extensive discussion of the properties of periodic structures at microwave frequencies is to be found in A. S. Harvey, "IRE Transactions on Microwave Theory and Techniques", Jan. 1960.

A whole series of slow-wave structures for the injection of microwave energy into receptacles and/or materials is described in the literature.

Of particular interest is the fact that the electric field connected with a particular power flow along the structure evidently must become greater as the group velocity becomes lower, i.e., for a constant flow of power the following equation applies:

$$E^2 \sim 1/v_g.$$

This field can become so great for low group velocities and can extend so far into space away from the guide structure that it is suitable for the production of non-thermal low-pressure plasmas. Such an application is discussed, for example, by the group of authors, E. S. Hotston, J. M. Weaver, and D. J. H. Wort, in "U.K.A.E.A. Research Report," CLM-R78, 1968. This is a theoretical discussion having to do with the input of microwave energy into a plasma. The energy in this case is coupled in by a slow-wave structure located outside of the plasma. The plasma itself is confined by a magnetic field.

U.S. Pat. No. 3,663,858 discloses the production of a low-pressure plasma in a plasma receptacle with a slow-wave structure of helical configuration.

To make the energy input uniform over the length of the structure, it is proposed both in the first-named German Pat. No. 31 47 986 and in U.S. Pat. Nos. 3,472,200 and 3,814,983 to arrange the structure or structures at an acute angle to the adjacent material. When a receptacle is used, a uniform plasma is to be achieved over the enitre length of the receptacle. The effectiveness and limits of this method are described in German Federal Pat. No. 31 47 986 so that, to eliminate the undesired influences, it is proposed to use two structures crossing one another at an acute angle with contrary energy injection. For a length of the excited plasma of about 450 mm, this known solution resulted in a uniformity sufficient for many applications, which uniformity varies between ±5% and ±10% depending on the monomer used for the plasma process. At the same time, however, practical operation shows a number of limitations of the known solution:

Owing to its complexity, it is a relatively complicated and expensive apparatus.

Since the substrate passes successively through two plasma zones of, as a rule, different strength, a change in the build-up of the coating is the result.

The structure length cannot be increased indefinitely, because in this case the difficulty arises that, as the structure length increases, the necessary angle relative to the microwave window becomes increasingly acute. This leads not only to mechanical but also to electrical instability.

On account of the division of the plasma length, which is needed for great substrate widths, into two or three structures arranged in tandem, the phenomenon of so-called "plasma bellies" occurs in the optically visible plasma, which are also reflected in an uneven distribution of the coating density. The reason for this phenomenon is not yet understood.

SUMMARY OF THE INVENTION

It is therefore an objective of the invention to improve an apparatus of the kind described above by achieving a great length in the plasma, with an extremely uniform energy distribution in the plasma, and with little complexity of construction.

This objective is acheived, according to the invention, in the apparatus described above, by providing the open microwave guide with a microwave feeder at least at both its extremities.

This type of construction is a complete departure from the design principles practiced heretofore, of providing only one microwave feeder at the end of each open microwave guide. If necessary, a so-called "dummy load" used to be connected to the opposite end of the open microwave guide through a microwave shunt. This is also described in German Pat. No. 31 47 986, but it does not lead to the solution of the existing problems. In the application of the invention, each microwave guide can be disposed perfectly parallel to the receptacle surface or to the window.

The substrate no longer needs to pass successively through two plasma zones of, in some cases, different strength, so that a largely more uniform build-up of the coating can be achieved.

Since the open microwave guide can be provided with additional microwave feeders almost as frequently as desired along its length, there are no practical limits to the variation of the length. By the elimination of an acute angle of incidence the system is stabilized not only mechanically but also electrically.

The phenomenon of "plasma bellies" does not occur.

If the number of microwave feeders is even, every two microwave feeders can be connected by a tee joint to a single microwave transmitter.

It is especially advantageous if at least two microwave feeders are connected to the at least one microwave transmitter with a fixed phasing. This can be accomplished preferably by coupling each single transmitter to two microwave feeders through the above-described feeder branching.

However, a plurality of transmitters with fixed phasing can also be used, so that in this case the microwave feeders are connected each to a microwave transmitter of its own.

According to a further development of the invention in connection with a receptacle in which a window of a material transparent to microwaves is located in a known manner, it is especially advantageous if its thickness corresponds to the equation $$\alpha = \lambda/4n$$

wherein "λ" is the wavelength of the microwave and "n" is the refractive index of the window material for the microwave.

The state of the art does not describe at all this determination of dimensions this is probably mainly due to the fact that the entire state of the art deals only with apparatus of very small dimensions in which the wall thickness or the thickness of the window is very small with respect to the wavelength which, in the case of the frequencies commonly used, amounts to about 12 cm (f=2.5 GHz).

In the case of large industrial installations, however, in view of the pressure difference which the window is expected to withstand, window thickness of about 15 to 20 mm are to be anticipated on a purely mathematical basis. In this case, however, a partial reflection of the microwave energy occurs both at the front surface and at the back surface of the window, so that a corresponding interference may be observed. Moreover, under the influence of the electrical field around the delay structure, a corresponding electromagnetic wave forms in the dielectric of the window.

It has been found according to the invention that this problem does not occur if the dimensional formula given above is followed. In the case of quartz glass in which n=1.94, the calculated window thickness will be d=30 mm, which has proven to be the optimum thickness.

Experiments performed with windows of dimensions computed in this manner have shown a clear improvement of the uniformity of the plasma zone combined with markedly less attenuation of the microwave power put into the plasma. It has been observed that the input power definitely recedes when the thickness of the window is reduced from 30 mm to 15 mm. As a consequence, the plasma would not ignite or would ignite only with difficulty.

Again, according to a further development of the invention it is especially advantageous if the surface of the window facing the microwave guide has a coating of a material with a smaller index of refraction than that of the window material.

In this manner it is possible to reduce the reflection of the microwave against the microwave window surface in contact with the atmosphere. Practical experiments have shown that conditions are optimum when the coating is a polytetrafluorethylene plate with a thickness of about 5 mm. In this case two opposite effects have to be weighed against one another: On the one hand the plasma becomes more uniform as the thickness of the coating increases, but on the other hand the input of the microwave energy becomes perceptibly poorer.

Lastly, it is again especially advantageous if the microwave guide is made in a symmetrical V-shape, and is closer to the window at the apex of the V than it is at its feed points.

The preferred embodiments of the subject of the invention, and their manner of operation, will be explained below in conjunction with FIGS. 1 to 5.

BRIEF DESCRIPTION OF THE DRAWINGS

FIG. 1 shows sections of a window and a microwave guide mounted over it.

FIG. 3 is a side view of a microwave guide having four feed points and two microwave transmitters.

DESCRIPTION OF THE PREFERRED EMBODIMENTS

Figure 2:
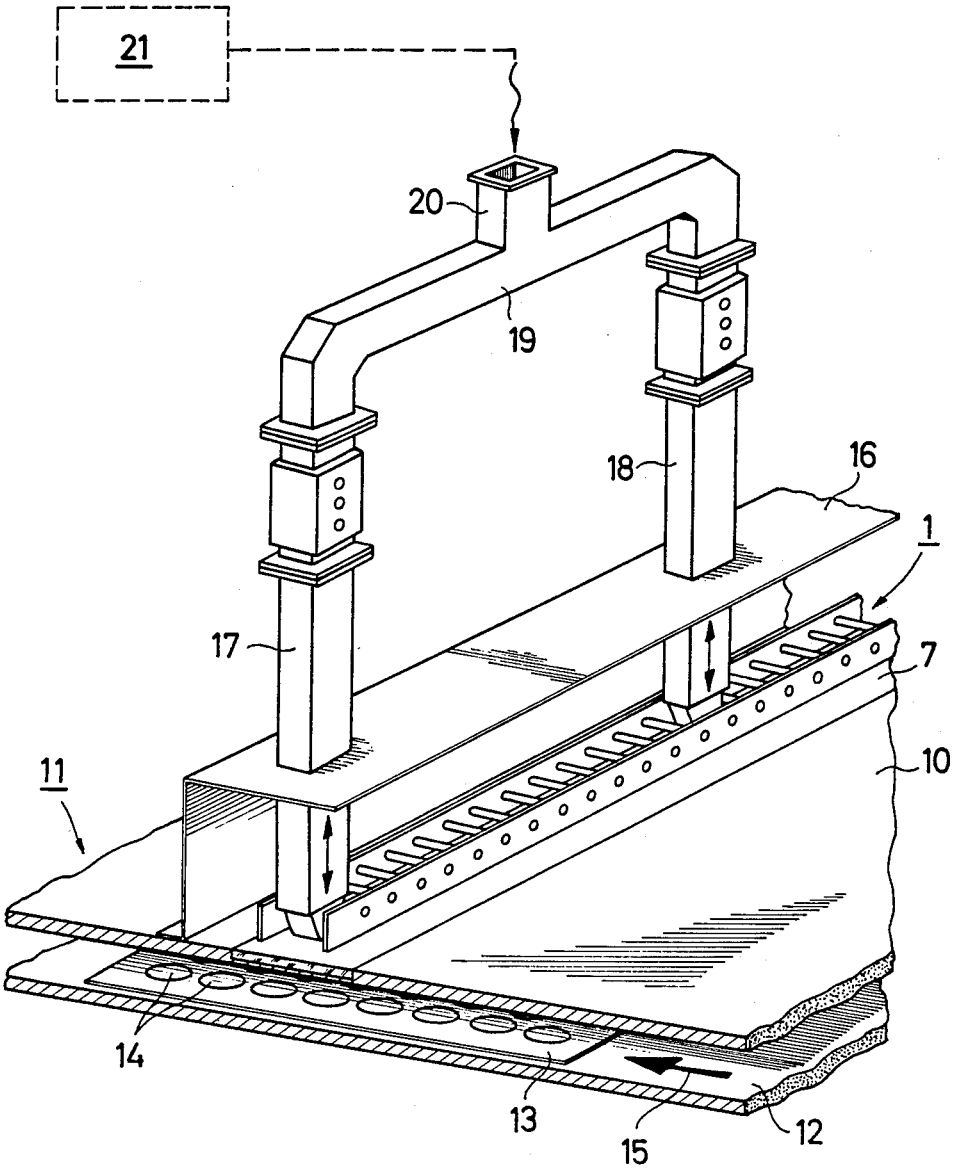
FIG. 2 is a perspective view of a vacuum chamber having a window, a microwave guide and two feed points, each partially cut away.

FIG. 1 shows a portion of the length of an open microwave guide 1 of the kind described above, over a window 7 that is permeable to microwaves. The microwave guide 1 consists of metal, namely of two parallel stringers 2 and 3 which are spanned at equidistant intervals by rungs 4 disposed at right angles to the stringers. The rungs are connected alternately each with one of two middle conductors 5 and 6.

The microwave-transparent window 7 is also shown partially cut away. It consists of a quartz glass plate 8 facing the plasma, with a thickness of 30 mm, and a coating 9 consisting of polytetrafluorethylene with a thickness of 5 mm.

A window 7 of this kind is also represented in FIG. 2; it constitutes the roof 10 of a vacuum chamber 11 and another plate 12 constitutes the floor thereof. A substrate holder 13 carrying numerous substrates 14 is moving through the space between the roof 10 and the floor 12. The direction of movement is indicated by an arrow 15, and it is at right angles to the longest axis of the window 7.

Over the window 7, and parallel thereto, there is disposed the open microwave guide 1, represented in a simplified manner. Only the rear part of a shielding housing 16 is represented.

The microwave guide 1 is provided at intervals with microwave feeders 17 and 18, which are connected to a microwave transmitter 21 by a tee junction 19 and a connecting section 20. In the present case the microwave feeder 17 is connected to the one end of the microwave guide 1. The microwave feeder 18 feeds into the microwave guide 1 at a point remote therefrom. A mirror-image symmetrical arrangement is situated at the other end of the microwave guide 1, which is not further represented here.

FIG. 3 shows a system which can be thought of as formed by doubling the arrangement in FIG. 2. In this case an additional microwave transmitter 22 is provided, which merges through a tee junction 23 into two additional microwave feeders 24 and 25 which lead into the microwave guide 1 in a mirror-image symmetry with the feeders 17 and 18. The microwave transmitters 21 and 22 are operated in a fixed phase relationship to one another, and the same fixed phasing in relation to the microwave guide 1 is assured by the tee junctions 19 and 23.

Figure 4:
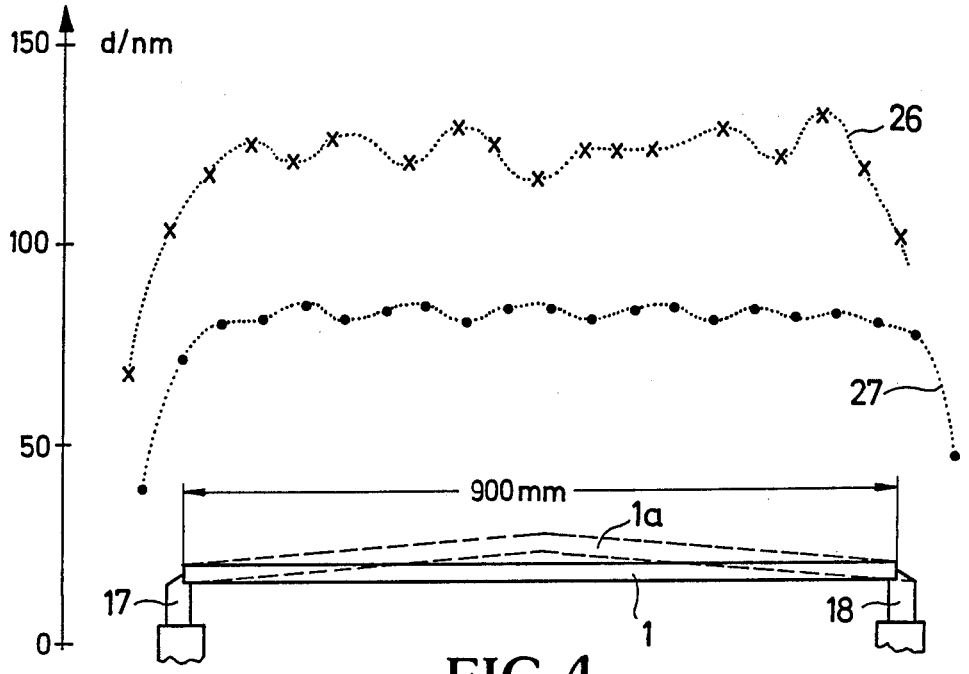
FIG. 4 is a graph of curves against the coating thicknesses.

FIG. 4 is a graphic representation of the experimental results obtained with two differently constructed microwave guides of 900 mm length each. This microwave guide was provided at both ends with the microwave feeders 17 and 18. In this manner a coating thickness distribution was obtained as indicated by the upper curve 26. Also observed was the formation of a slight minimum in the center of the microwave guide. By means of a shallow V-shaped configuration of a microwave guide 1*a*, which is indicated by the broken lines, it was possible to eliminate this minimum in the center, as can be seen in the bottom curve 27. It is to be noted that a microwave guide of only 900 mm length represents a doubling of the length of the formerly available microwave guides. The deviations in the coating thickness uniformity were between about ±5% and ±10%. On the ordinates is represented in nanometers (nm) the coating thickness pertaining to curves 26 and 27 for coatings of hexamethylene disilazane and of acetylene.

In FIG. 3, 28 identifies matching circuits in the form of three-rod tuners. These have points for measuring the forward power $P_V$. They are preceded by a circulator 29 for tuning out the back power $P_R$ which is fed through a microwave guide 30 of a dummy load which is not shown. The transmitters 21 and 22 are thus protected from the back power.

Figure 5:
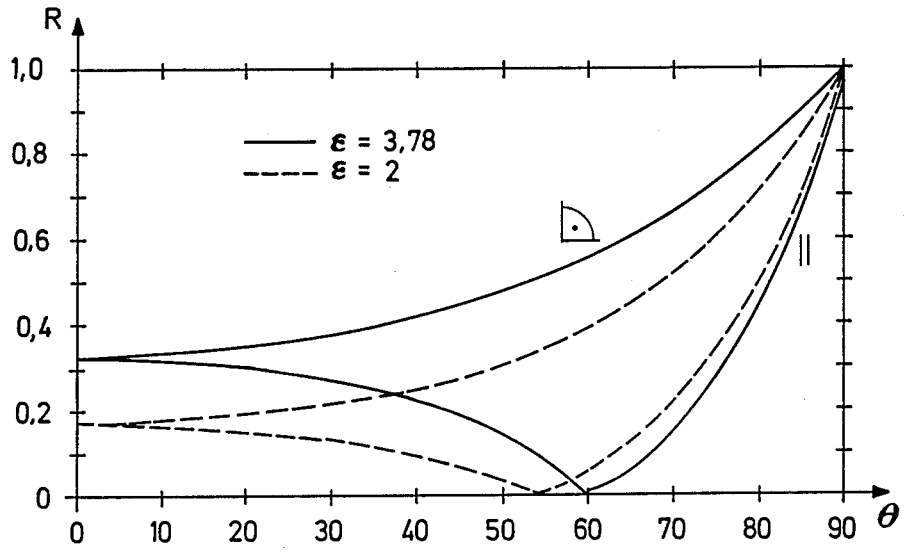
FIG. 5 is another graph of the reflection in windows with and without the coating of polytetrafluorethylene.

FIG. 5 shows the reflection of a microwave with a frequency of 2.5 GHz from the atmosphere face of the microwave window in both directions of polarization for all angles of incidence. The angles of incidence from 0 to 90 degrees are plotted on the abscissa. The solid lines represent a quartz glass surface; the broken lines represent a window with a polytetrafluorethylene coating. Integration over all angles of incidence show a decided reduction of reflection to about half, if instead of a plain quartz glass window a window is used which is provided with a coating 5 mm thick of polytetrafluorethylene.

There has thus been shown and described a novel apparatus for injecting microwave energy into a receptacle which fulfills all the objects and advantages sought therefor. Many changes, modifications, variations and other uses and applications of the subject invention will, however, become apparent to those skilled in the art after considering this specification and the accompanying drawings which disclose the preferred embodiments thereof. All such changes, modifications, variations and other uses and applications which do not depart from the spirit and scope of the invention are deemed to be covered by the invention which is limited only by the claims which follow.

We claim:

1. In apparatus for injecting microwave energy into a receptacle that is at least partially transparent to microwave energy, said apparatus comprising at least one microwave transmitter and one open microwave guide which is connected to the microwave transmitter and which is situated in the immediate vicinity of the receptacle, said open microwave guide having a plurality of parallel rungs and forming a slow-wave structure of the strapped bar type, the improvement wherein a microwave feeder is disposed at at least both ends of the open microwave guide; wherein the receptacle has a window of microwave transparent material; and wherein the microwave guide is of a symmetrical V-shape, and at the apex of the V it is at a smaller distance from said window than at its feed points.

2. Apparatus according to claim 1, wherein a microwave feeder is disposed not only at both ends of the open microwave guide, but also at at least one point lying between said ends.

3. Apparatus according to claim 1, wherein the at least two microwave feeders are connected with fixed phasing to the at least one microwave transmitter.

4. Apparatus according to claim 1, wherein each microwave feeder is connected with its own microwave transmitter.

5. Apparatus according to claim 1, wherein the thickness of said window corresponds to the equation $$d=\lambda/4n,$$

wherein "λ" is the wavelength of the microwave and "n" is the index of refraction of the window material for the microwave.

6. Apparatus according to claim 5, wherein the surface of the window facing the microwave guide has a coating of a material with a smaller refractive index than that of the window material.

* * * * *